United States Patent [19]

Nishida

[11] Patent Number: 4,643,685

[45] Date of Patent: Feb. 17, 1987

[54] WATER JET PROPELLED CRAFT

[75] Inventor: Hiroshi Nishida, Miki, Japan

[73] Assignee: Kawasaki Jukogyo Kabushiki Kaisha, Hyogo, Japan

[21] Appl. No.: 748,823

[22] Filed: Jun. 26, 1985

[30] Foreign Application Priority Data

Jun. 29, 1984 [JP] Japan ..... 59-135585

[51] Int. Cl.[4] ..... B63H 11/04; B63H 11/113

[52] U.S. Cl. ..... 440/42; 60/221; 440/89

[58] Field of Search ..... 440/38, 40, 42, 43, 440/67, 89, 41; 60/221

[56] References Cited

U.S. PATENT DOCUMENTS 2,570,509 10/1951 Bandli ..... 440/89
3,209,534 10/1965 Stallman ..... 440/41
3,943,876 3/1976 Kiekhaefer ..... 440/89 X

*Primary Examiner*—Sherman D. Basinger

[57] ABSTRACT

A water jet propelled craft equipped at the rear section of the craft with a water jet pump driven by an engine. A cylindrical member is provided so as to extend backwards around the rear end of a pump outlet nozzle of the water jet pump, and an outlet of exhaust gas from the engine opens backwards between the outer surface of the pump nozzle and the inner surface of the cylindrical member.

4 Claims, 5 Drawing Figures

WATER JET PROPELLED CRAFT

FIELD OF THE INVENTION AND RELATED ART STATEMENT

This invention relates to a water jet propelled craft, in particular to a structure of the outlet of the engine exhaust pipe.

In the well-known water jet propelled craft, an in-air exhaust system is often employed to evacuate into the air at the fore section of the hull the exhaust gas flowing out from the engine which is installed to drive the water jet pump. Drawbacks of this type of exhaust system according to the prior art lie in a high level of noise, and dirt accumulated on the hull.

OBJECT AND SUMMARY OF THE INVENTION

The object of the invention is to provide an exhaust system capable of eliminating said drawbacks of the prior type of the in-air exhaust system which is employed in the conventional water jet propelled crafts, and to provide a water jet propelled craft having the exhaust outlet structure suitable for the purpose of dealing successfully with problems which may occur in the embodiments according to the present invention.

To achieve aforesaid object, a water jet propelled craft in accordance with the invention is designed to allow the exhaust gas from the engine to be discharged into the water jet stream produced by the pump. In addition, to eliminate the drawbacks which are liable to occur in the in-jet-stream exhaust system, such as resistance added to the flow of the jet stream caused by the presence of the exhaust tube outlet, or a rise of the back pressure of the engine owing to the blockage of the exhuast gas flow by the jet stream, the rear end of the pump nozzle of the water jet pump has a cylinder coaxially mounted around it and extended further backward so as to allow the exhaust gas to flow backward in the water between the outer surface of the pump nozzle and the inner one of the cylinder.

As aforesaid structure does not offer any protection in the path of the jet stream, no resistance can be added to the jet stream generated by the water jet pump, thus leading to no loss of the driving force as well as the exhaust is smoothly drawn out by the jet stream.

DETAILED DESCRIPTION OF THE PREFERRED EMBODIMENT

The following depicts in detail an embodiment according to the invention.

Figure 1:
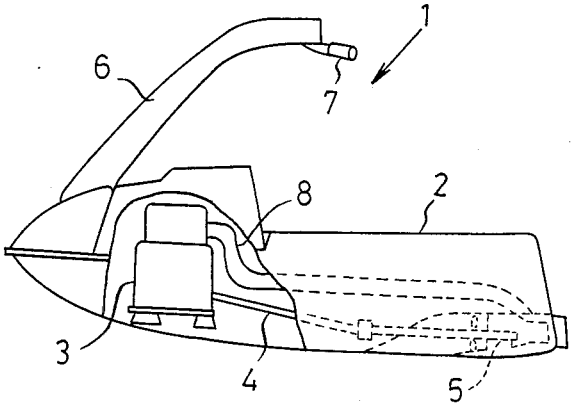
FIG. 1 is a side view, with portion broken away for clarity, of a water jet propelled craft in accordance with the present invention.

Of the embodiment shown in FIG. 1, an engine 3 installed at the fore region of the hull 2 of a water jet propelled craft 1 drives the water jet pump 5 secured on the bottom of the rear part of the craft via the propeller shaft 4. A handle bar 7 is mounted on a handle pole 6 extending up from the fore part of the craft. An exhaust pipe 8 originating from the engine 3 runs backward through the inside of the hull 2 to the rear end portion of the water jet pump 5. The structure of the exhaust outlet of the engine 3 is depicted in both FIGS. 2 and 3.

Figure 2:
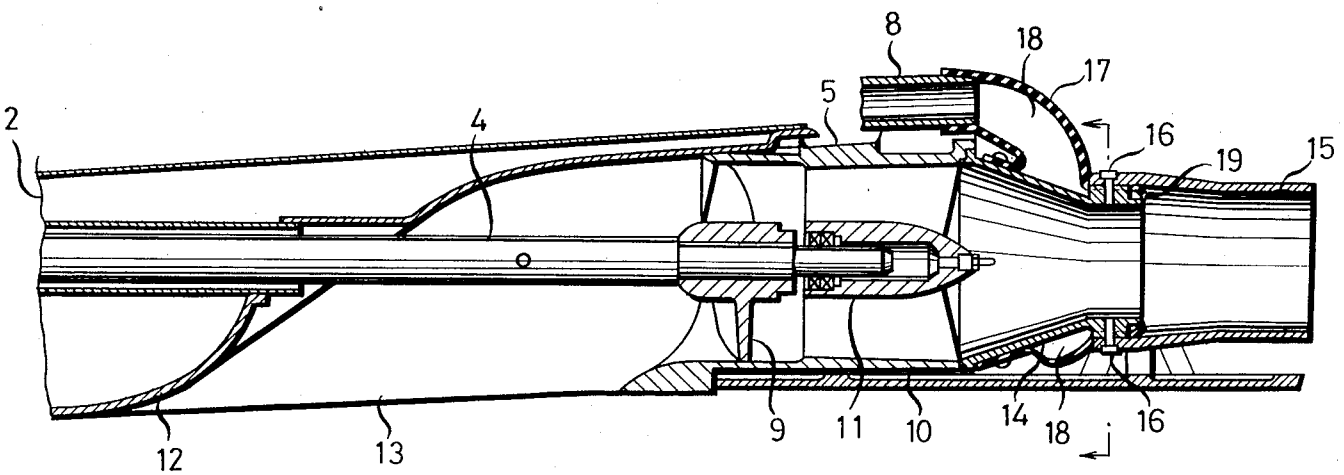
FIG. 2 is a longitudinally sectional view of the exhaust outlet structure.

As shown in FIG. 2, the impeller 9 of the water jet pump 5 is secured on the propeller shaft 4, and the propeller shaft 4 is supported at the rear end by the bearing 11 securely housed in the pump housing 10. The frontal end portion of the pump housing 10 together with the bottom wall 12 of the hull 2 forms a suction nozzle 13 which opens in the bottom of the hull 2. To the rear end of the pump housing 10 is connected a pump nozzle 14.

Figure 3:
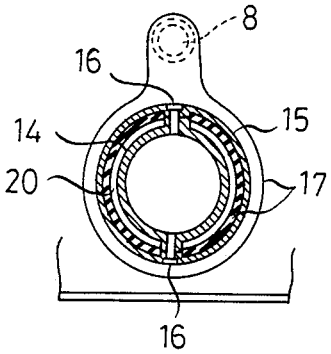
FIG. 3 is a sectional view taken in the direction of the arrows along the line III—III in FIG. 2.

Furthermore, on the rear end of the pump nozzle 14 is mounted a steering nozzle 15 surrounding the rear end of the pump nozzle 14 and extending further backward by means of pins 16 which are inserted in such a way that the steering nozzle 15 is able to horizontally rotate around the pins 16. The outer surface of the pump nozzle 14 is surrounded by an exhaust tube 17 of resilient material to which the exhaust pipe 8 coming from the engine 3 is jointed. Said resilient exhaust tube 17 forms an exhaust path 18 around the outer surface of the pump nozzle 14, and passes between the pump nozzle 14 and the steering nozzle 15, as shown in FIG. 3 as well. A lip 19 whose tip is tapered off is mounted with its tip in contact with the rear end rim of the pump nozzle 14.

In this embodiment, the water is pumped up through the suction nozzle 13 from under the hull 2 by the impeller 9 driven by the engine 3, transformed into the jet stream in the pump nozzle 14, and discharged from the steering nozzle 15 to provide a force driving the watercraft. The steering nozzle 15 is actuated by means of the handle bar 7. On the other hand, the exhaust gas from the engine 3 flows through the exhaust pipe 8 and exhaust path 18 around the outside of the pump nozzle 14, and causes the lip 19 to open before discharged backward (in the same direction as the jet stream) into the jet stream in the steering nozzle 15.

In this embodiment, the exhaust gas is smoothly drawn in and led out by the jet stream, because the agreement of the direction of the exhaust gas flow with that of the jet water flow as well as no projections in the jet stream help eliminate resistance to the jet stream and back pressure of the engine 3 raised due to the jet stream. Therefore, no loss in an engine output can take place, thus utilizing the maximum driving force expected from the engine 3. Once the engine 3 stopped, a lowered exhaust gas pressure enables the lip 19 to close an exhaust outlet 20, thereby preventing the water from flowing into the exhaust path 18.

In this embodiment according to the invention, though the exhaust tube 17 of a resilient substance is made independent of the pump nozzle 14, the pump nozzle 14 and the exhaust tube 17 can be both molded into one piece, and a separate resilient lip 19 can be mounted at the rear end of the exhaust tube 17.

And also, the lip 19 may be placed so as to be in contact with the outer periphery of the down-stream end of the pump nozzle 14.

Figure 4:
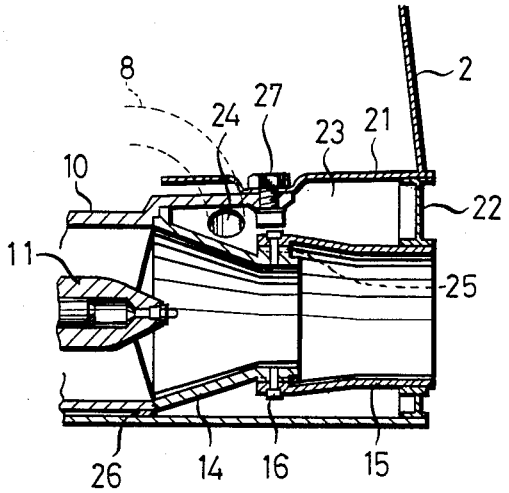
FIG. 4 is a longitudinally sectional view of the exhaust outlet structure of another embodiment according to the invention.
Figure 5:
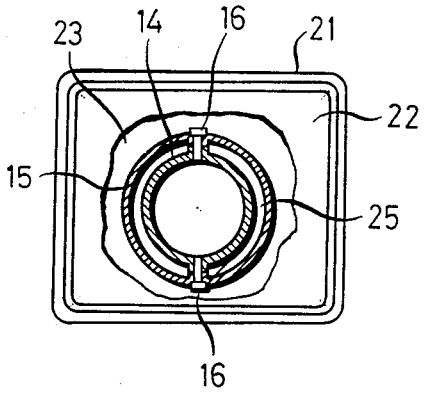
FIG. 5 is a sectional rear view of the embodiment illustrated in FIG. 4.

In FIGS. 4 and 5 is shown another embodiment according to the invention of the exhaust gas outlet structure. Here, FIGS. 4 and 5 employ the reference numerals identical with FIGS. 2 and 3, when they refer components performing the substantially same functions.

Of this exhaust outlet structure, a seal membrane 22 of a resilient material (like rubber) is put between the outer rear surface of the steering nozzle 15 and the rear end of the accomodation housing wall 21 of the hull 2 in which the water jet pump 5 is installed, and an exhaust chamber 23 is formed of the outer surface of the pump nozzle 14 and the steering nozzle 15 as well as the inner surface of the accomodation housing wall 21. The exhaust pipe 8 extending from the engine 3 is connected to the exhaust chamber 23 through an exhaust port 24. And further, as shown in FIG. 5, an annular exhaust port 25 is formed between the outer rear end of the pump nozzle 14 and the inner front end surface of the steering nozzle 15 so as to open backward in the jet stream.

Therefore, the exhaust gas from the engine 3 is guided from the exhaust pipe 8 through the exhaust port 24 into the exhaust chamber, passes through the annular exhaust port 25 between the pump nozzle 14 and the steering nozzle 15, and eventually is discharged backward into the jet stream.

Flexibility of the resilient seal membrane 22 allows the steering nozzle 15 to rotate and the exhaust chamber 23 to be watertight. In FIG. 4, Numeral 26 refers to a sealant at the front end of the exhaust chamber 23, inserted between the pump housing 10 and the accomodation housing wall 21. Numeral 27 refers to bolts for fixing the water jet pump 5 to the accomodation housing wall 21.

In this connection, the same kind of the resilient lip as that employed in aforesaid embodiment can be mounted as a check valve at the annular exhaust port 25 in this embodiment.

In the case where a separate rudder is equipped at the end of the hull in place of the steering nozzle 15 on the rear end of the pump nozzle 14, an exhaust nozzle will be fixed around the rear end of the pump nozzle 14, forming an annular exhaust port between the pump nozzle 14 and the exhaust nozzle.

This invention permits the exhaust gas to flow into the jet stream, thereby reducing exhaust gas noise level, and does not allow the exhaust gas to dirty the hull. No decrease in driving force or engine output takes place because no interference is present between the jet stream in the jet pump and the exhaust system of the engine.

What is claimed is:

1. A water jet propelled craft having a hull and a water jet pump driven by an engine at the rear section of the hull, comprising a steering nozzle extending backwards around the rear end of a pump outlet nozzle of said water jet pump capable of rotation abut a perpendicular axis passing through the center of the rear end of said pump nozzle, an exhaust gas outlet opening backwards between the outer periphery of said pump outlet nozzle and the inner surface of said steering nozzle, and a resilient exhaust tube surrounding said pump nozzle and connected to an exhaust pipe from the engine, the rear end of said resilient exhaust tube being fixed to the front end of said steering nozzle.

2. A water jet propelled craft having a hull and a water jet pump driven by an engine at the rear section of the hull, comprising a steering nozzle extending backwards around the rear end of a pump outlet nozzle of said water jet pump capable of rotation about a perpendicular axis passing through the center of the rear end of said pump nozzle, an exhaust gas outlet opening backwards between the outer periphery of said pump outlet nozzle and the inner surface of said steering nozzle, an accommodation housing located around said pump nozzle and steering nozzle connected to an exhaust pipe of the engine and fixed on the hull, and a flexible sealant membrane placed between the rear end of said steering nozzle and the rear end of said accommodation housing to form an exhaust chamber.

3. A water jet propelled craft having a hull and a water jet pump driven by an engine at the rear section of the hull, comprising a steering nozzle extending backwards around the rear end of a pump outlet nozzle of said water jet pump capable of rotation about a perpendicular axis passing through the center of the rear end of said pump nozzle, an exhaust gas outlet opening backwards between the outer periphery of said pump outlet nozzle and the inner surface of said steering nozzle, and an exhaust tube surrounding said pump nozzle and connected to an exhaust pipe from the engine, the rear end of said exhaust tube being fixed to the front end of said steering nozzle.

4. A water jet propelled craft as claimed in claim 1, further comprising a resilient lip at said exhaust gas outlet, which is opened outwards by a pressure of the inner exhaust gas, and is closed inwards by a pressure of the outer water.

* * * * *